US007523938B2

(12) United States Patent
Chuang

(10) Patent No.: US 7,523,938 B2
(45) Date of Patent: Apr. 28, 2009

(54) 3D JIGSAW PUZZLE

(76) Inventor: Shih-Hung Chuang, 14F-2, No. 343, Chungho Rd., Yungho City, Taipei Hsien (TW)

( * ) Notice: Subject to any disclaimer, the term of this patent is extended or adjusted under 35 U.S.C. 154(b) by 1250 days.

(21) Appl. No.: 10/196,251

(22) Filed: Jul. 17, 2002

(65) Prior Publication Data

US 2004/0012147 A1 Jan. 22, 2004

(51) Int. Cl.
*A63F 9/12* (2006.01)

(52) U.S. Cl. ..... 273/157 R

(58) Field of Classification Search ..... 273/157 R, 273/156, 153 R

See application file for complete search history.

(56) References Cited

U.S. PATENT DOCUMENTS

| | | | | | |
|---|---|---|---|---|---|
| 2,987,318 | A | * | 6/1961 | Hammer | 273/157 R |
| 3,578,331 | A | * | 5/1971 | DeGast | 273/157 R |
| 3,691,704 | A | * | 9/1972 | Novak | 273/157 R |
| 5,217,226 | A | * | 6/1993 | Christopher | 273/157 R |
| 5,842,697 | A | * | 12/1998 | Scott et al. | 273/157 R |

* cited by examiner

*Primary Examiner*—Steven Wong
(74) *Attorney, Agent, or Firm*—Hershkovitz & Associates, LLC; Abraham Hershkovitz

(57) ABSTRACT

A three dimensional jigsaw puzzle has pieces with protrusions and cutouts. The protrusions and cutouts of every two adjacent pieces correspond to each other. Each piece is a tangential area of a sphere so that when the pieces are all combined, the sphere is formed.

9 Claims, 2 Drawing Sheets

3D JIGSAW PUZZLE

BACKGROUND OF THE INVENTION

1. Field of the Invention

The present invention relates to a three dimensional jigsaw puzzle, and more particularly to a three dimensional jigsaw puzzle composed of pieces and a hollow interior. Each piece has protrusions and cutouts respectively corresponding to the cutouts and protrusions of an adjacent piece so as to form a complete pattern when the jigsaw puzzle is completed.

2. Description of Related Art

Jigsaw puzzles are popular toys for children and even adults. Conventional jigsaw puzzles generally have planar pictures which have cut up into pieces, and then the pieces are fitted together to recreate the pictures again. The quantities of pieces in puzzles can be varied by manufacturers so that assorted difficulty levels in doing the puzzles are achieved in order satisfy consumer demands.

There have been some jigsaw puzzles invented that are called three-dimensional puzzles. One of the three dimensional puzzles is composed of cubic pieces that each have six surfaces painted with various patterns and that can be recombined to form six pictures corresponding to the respective surfaces of the cubic pieces.

Another three-dimensional jigsaw puzzle has a dimensional frame being composed of horizontal brackets and vertical brackets. The brackets have a plurality of apertures defined therein. Puzzle pieces with poles can be mounted on the brackets by the poles inserted in the apertures to form a three-dimensional shape.

In a third three-dimensional jigsaw puzzle, there are a plurality of sheets painted with the same picture. The sheets are cut according to the pieces of the jigsaw puzzle. The pieces are respectively adhered with the sheets having different numbers. Whereby, the pieces have different thickness and the picture is recreated by the pieces so as to present a three-dimensional effect.

However, all the conventional jigsaw puzzles present only two-dimensional pictures combined by the pieces. There is no true three-dimensional effect in the jigsaw puzzles.

In order to provide a three dimensional effect, the invention provides an improved jigsaw puzzle to mitigate and/or obviate the aforementioned problems.

SUMMARY OF THE INVENTION

The primary objective of the invention is to provide a jigsaw puzzle which has a true three-dimensional effect and uses no auxiliary assistance, such as a bladder inside the three dimensional jigsaw puzzle so that the difficulty of assembling the jigsaw puzzle is increased not only by the quantity of the pieces, but also by forming and maintaining the 3D jigsaw puzzle.

According to the invention, a three dimensional jigsaw puzzle comprises a self-supporting sphere formed by a plurality of interfitting puzzle pieces, each of the plurality of puzzle pieces having (a) a plurality of protrusions and a plurality of cutouts formed in a periphery thereof, and (b) an upper surface and an opposing lower surface, the upper surface of each of said puzzle pieces having an arcuate contour defining a spherical surface portion. The lower surface of each of the puzzle pieces has a complementary contour to the arcuate contour of a corresponding upper surface, the upper and lower surfaces being concentric to define a uniform or unitary thickness for each piece.

Each of the plurality of puzzle pieces may have a non-regular geometric shape. Each of the plurality of puzzle pieces may have a periphery defined by variable radius curves. Each of the plurality of puzzle pieces may have a broad shouldered human shape periphery. The broad shouldered human shape periphery of the plurality of puzzle pieces may allow as many as six of the plurality of puzzle pieces to meet at a common point. As many as six of the plurality of puzzle pieces may meet at a common point at several locations on the sphere.

According to another aspect of the invention, a three dimensional jigsaw puzzle comprises a self-supporting sphere formed by a plurality of interfitting puzzle pieces, each of the plurality of puzzle pieces having a plurality of protrusions and a plurality of cutouts formed in a periphery thereof, and an upper surface and an opposing lower surface, the upper surface of each of said puzzle pieces having an arcuate contour defining a spherical surface portion, the lower surface of each of the puzzle pieces having a complementary contour to the arcuate contour of a corresponding upper surface, the upper and lower surfaces being concentric to define a uniform thickness for each piece, wherein each of the plurality of puzzle pieces has a non-regular geometric shape and a periphery defined by variable radius curves, wherein the non-regular geometric shape of the plurality of puzzle pieces allows as many as six of the plurality of puzzle pieces to meet at a common point at several locations on the sphere.

According to yet another aspect of the invention, a three dimensional jigsaw puzzle comprises a self-supporting sphere formed by a plurality of interfitting puzzle pieces, each of the plurality of puzzle pieces having (a) a plurality of protrusions and a plurality of cutouts formed in a periphery thereof, and (b) an upper surface and an opposing lower surface, the upper surface of each of said puzzle pieces having an arcuate contour defining a spherical surface portion, the lower surface of each of the puzzle pieces having a complementary contour to the arcuate contour of a corresponding upper surface, the upper and lower surfaces being concentric to define a unitary thickness for each piece, each of the plurality of puzzle pieces having a periphery defined by variable radius curves, each of the plurality of puzzle pieces having a broad shouldered human shape periphery to allow as many as six of the plurality of puzzle pieces to meet at a common point at several locations on the sphere.

Other objects, advantages and novel features of the invention will become more apparent from the following detailed description when taken in conjunction with the accompanying drawings.

DETAILED DESCRIPTION OF THE PREFERRED EMBODIMENT

Figure 1:
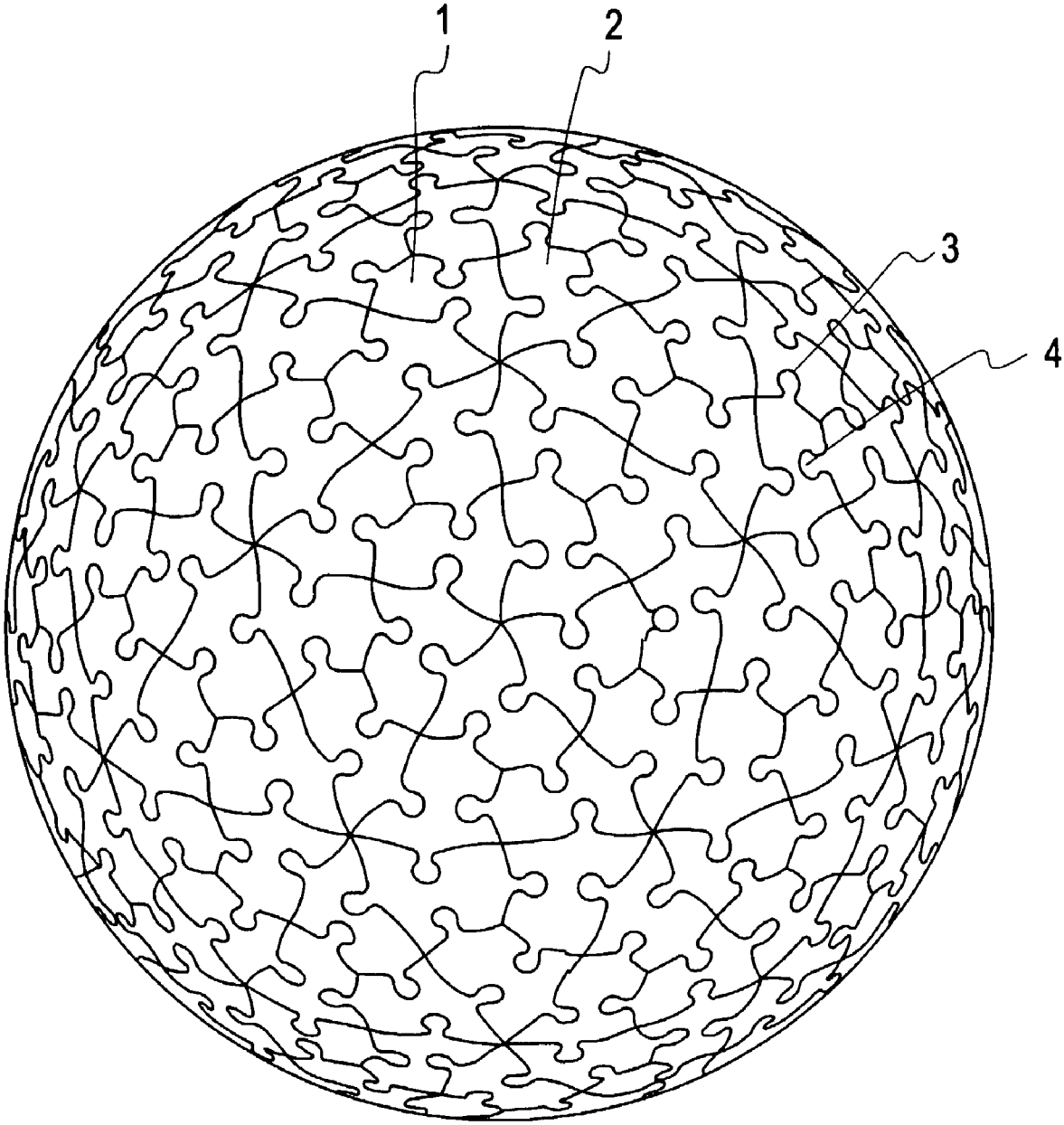
FIG. 1 is a plan view showing the 3D jigsaw puzzle.
Figure 2:
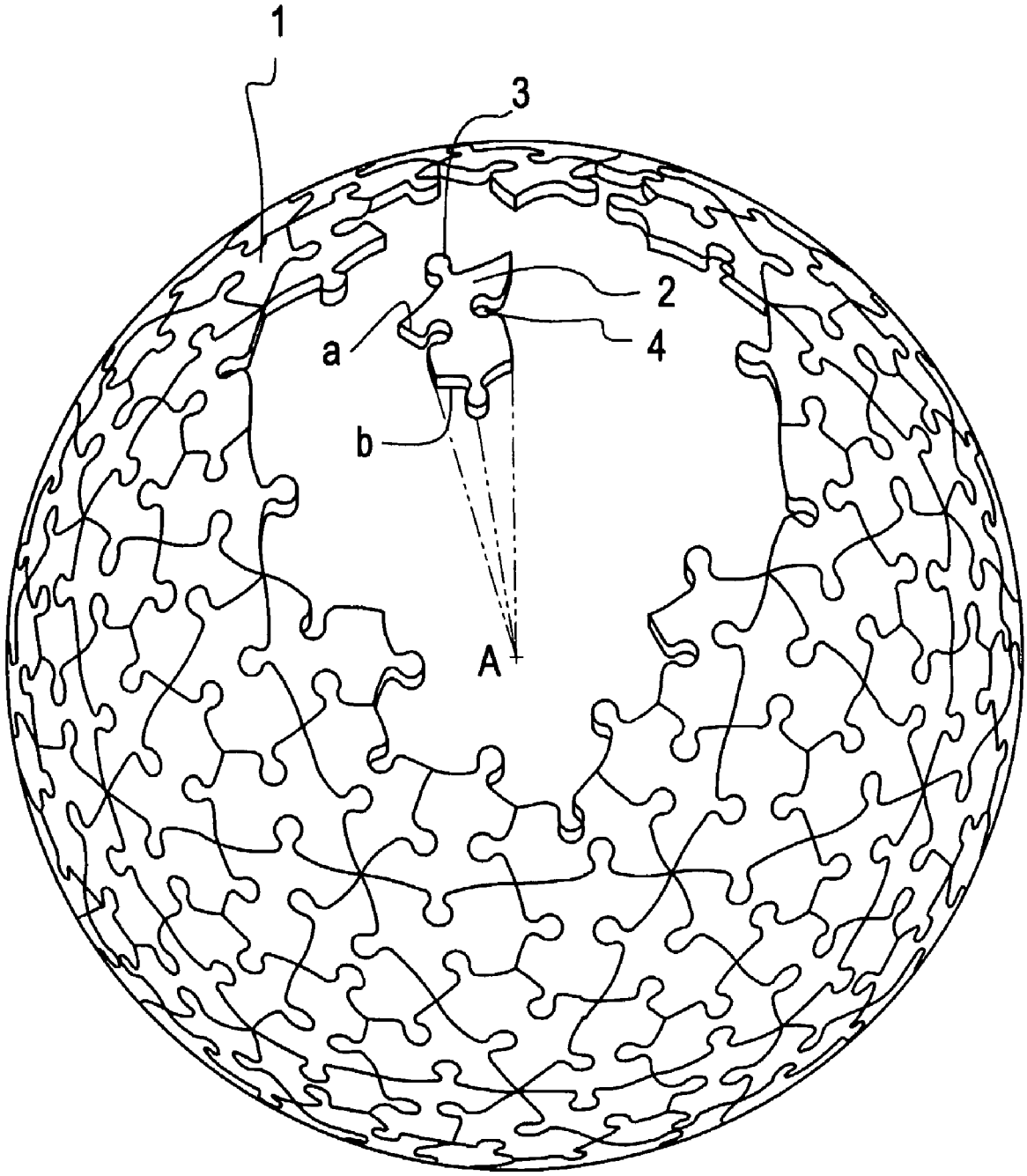
FIG. 2 is a perspective view of the 3D jigsaw puzzle in FIG. 1, wherein a portion of the pieces is removed to show that the 3D jigsaw puzzle is completely hollow.

With reference to FIGS. 1 and 2, a three-dimensional jigsaw puzzle in accordance with the invention is a sphere (1) composed of pieces (2). Each piece (2) has a unitary thickness and has protrusions (3) and cutouts (4). The protrusions (3) and cutouts (4) of every two adjacent pieces (2) are formed to correspond to each other and each of the pieces (2) has side faces each having an upper contour and a lower contour, protrusions (3) and cutouts (4), wherein a radius of the sphere (1) passes through the lower contour first and then upper contour, so that after combination of all the pieces (2), the sphere (1) is recreated. That is, from FIG. 2 of the present invention, each piece (2) has side faces each defined by an upper contour (a) and a lower contour (b), wherein a radius from the center of the sphere (1) passes through the lower contour (b) first and then the upper contour (a).

In another embodiment, each of the pieces (2) is able to be painted with a portion of a picture so that when combining the sphere (1), each piece (2) provides a clue to the player to form the entire sphere (1).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A three dimensional jigsaw puzzle comprising a self-supporting sphere formed by a plurality of interfitting puzzle pieces, each of said plurality of puzzle pieces having (a) a plurality of protrusions and a plurality of cutouts formed in a periphery thereof, and (b) an upper surface and an opposing lower surface, said upper surface of each of said puzzle pieces having an arcuate contour defining a spherical surface portion, said lower surface of each of said puzzle pieces having a complementary contour to said arcuate contour of a corresponding upper surface, said upper and lower surfaces being concentric to define a uniform or unitary thickness for each piece, wherein each of said plurality of puzzle pieces has a broad shouldered human shape periphery, wherein the broad shouldered human shape periphery of said plurality of puzzle pieces allows as many as six of the plurality of puzzle pieces to meet at a common point.

2. The three dimensional jigsaw puzzle according to claim 1, wherein as many as six of the plurality of puzzle pieces meet at a common point at several locations on the sphere.

3. A three dimensional jigsaw puzzle comprising a self-supporting sphere formed by a plurality of interfitting puzzle pieces, each of said plurality of puzzle pieces having (a) a plurality of protrusions and a plurality of cutouts formed in a periphery thereof, and (b) an uppersurface and an opposing lower surface, said upper surface of each of said puzzle pieces having an arcuate contour defining a spherical surface portion, said lower surface of each of said puzzle pieces having a complementary contour to said arcuate contour of a corresponding upper surface, said upper and lower surfaces being concentric to define a uniform thickness for each piece, wherein each of said plurality of puzzle pieces has a non-regular geometric shape and a periphery defined by variable radius curves in the shape of a broad shouldered human, the broad shouldered human shape periphery of said plurality of puzzle pieces allowing as many as six of the plurality of puzzle pieces to meet at a common point.

4. A three dimensional jigsaw puzzle comprising a self-supporting sphere formed by a plurality of interfitting puzzle pieces, each of said plurality of puzzle pieces having (a) a plurality of protrusions and a plurality of cutouts formed in a periphery thereof, and (b) an upper surface and an opposing lower surface, said upper surface of each of said puzzle pieces having an arcuate contour defining a spherical surface portion, said lower surface of each of said puzzle pieces having a complementary contour to said arcuate contour of a corresponding upper surface, said upper and lower surfaces being concentric to define a uniform or unitary thickness for each piece, wherein each of said plurality of puzzle pieces has a non-regular geometric shape and a periphery defined by variable radius curves in the shape of a broad shouldered human, the broad shouldered human shape periphery of said plurality of puzzle pieces allowing as many as six of the plurality of puzzle pieces to meet at a common point at several locations on the sphere.

5. A three dimensional jigsaw puzzle comprising a self-supporting sphere formed by a plurality of interfitting puzzle pieces, each of said plurality of puzzle pieces having (a) a plurality of protrusions and a plurality of cutouts formed in a periphery thereof, and (b) an upper surface and an opposing lower surface, said upper surface of each of said puzzle pieces having an arcuate contour defining a spherical surface portion, said lower surface of each of said puzzle pieces having a complementary contour to said arcuate contour of a corresponding upper surface, said upper and lower surfaces being concentric to define a uniform or unitary thickness for each piece, wherein each of said plurality of puzzle pieces has a periphery which allows as many as six of the plurality of puzzle pieces to meet at a common point.

6. A three dimensional jigsaw puzzle comprising a self-supporting sphere formed by a plurality of interfitting puzzle pieces, each of said plurality of puzzle pieces having (a) a plurality of protrusions and a plurality of cutouts formed in a periphery thereof, and (b) an upper surface and an opposing lower surface, said upper surface of each of said puzzle pieces having an arcuate contour defining a spherical surface portion, said lower surface of each of said puzzle pieces having a complementary contour to said arcuate contour of a corresponding upper surface, said upper and lower surfaces being concentric to define a uniform or unitary thickness for each piece, wherein each of said plurality of puzzle pieces has a periphery which allows as many as six of the plurality of puzzle pieces to meet at a common point at several locations on the sphere.

7. A three dimensional jigsaw puzzle comprising a self-supporting sphere formed by a plurality of interfitting puzzle pieces, each of said plurality of puzzle pieces having (a) a plurality of protrusions and a plurality of cutouts formed in a periphery thereof, and (b) an upper surface and an opposing lower surface, said upper surface of each of said puzzle pieces having an arcuate contour defining a spherical surface portion, said lower surface of each of said puzzle pieces having a complementary contour to said arcuate contour of a corresponding upper surface, said upper and lower surfaces being concentric to define a uniform or unitary thickness for each piece, wherein each of said plurality of puzzle pieces has a non-regular geometric shape which allows as many as six of the plurality of puzzle pieces to meet at a common point.

8. A three dimensional jigsaw puzzle comprising a self-supporting sphere formed by a plurality of interfitting puzzle pieces, each of said plurality of puzzle pieces having a plurality of protrusions and a plurality of cutouts formed in a periphery thereof, and an upper surface and an opposing lower surface, said upper surface of each of said puzzle pieces having an arcuate contour defining a spherical surface portion, said lower surface of each of said puzzle pieces having a complementary contour to said arcuate contour of a corresponding upper surface, said upper and lower surfaces being concentric to define a uniform thickness for each piece, wherein each of said plurality of puzzle pieces has a non-regular geometric shape and a periphery defined by variable radius curves, wherein the non-regular geometric shape of said plurality of puzzle pieces allows as many as six of the plurality of puzzle pieces to meet at a common point at several locations on the sphere.

9. A three dimensional jigsaw puzzle comprising a self-supporting sphere formed by a plurality of interfitting puzzle pieces, each of said plurality of puzzle pieces having (a) a plurality of protrusions and a plurality of cutouts formed in a periphery thereof, and (b) an upper surface and an opposing lower surface, said upper surface of each of said puzzle pieces having an arcuate contour defining a spherical surface portion, said lower surface of each of said puzzle pieces having a complementary contour to said arcuate contour of a corresponding upper surface, said upper and lower surfaces being concentric to define a unitary thickness for each piece, each of said plurality of puzzle pieces having a periphery defined by variable radius curves, each of said plurality of puzzle pieces having a broad shouldered human shape periphery to allow as many as six of the plurality of puzzle pieces to meet at a common point at several locations on the sphere.

* * * * *